United States Patent [19]

Tobery et al.

[11] Patent Number: 4,527,397

[45] Date of Patent: Jul. 9, 1985

[54] TURBINE COMBUSTOR HAVING ENHANCED WALL COOLING FOR LONGER COMBUSTOR LIFE AT HIGH COMBUSTOR OUTLET GAS TEMPERATURES

[75] Inventors: Edward W. Tobery, Westtown Township, Chester County; Stephen R. Parker, Nether Providence, both of Pa.

[73] Assignee: Westinghouse Electric Corp., Pittsburgh, Pa.

[21] Appl. No.: 517,929

[22] Filed: Jul. 28, 1983

Related U.S. Application Data

[63] Continuation of Ser. No. 248,123, Mar. 27, 1981.

[51] Int. Cl.[3] ..... F02C 7/18

[52] U.S. Cl. ..... 60/757

[58] Field of Search ..... 60/757, 755, 756, 39.32; 431/351, 352, 353

[56] References Cited

U.S. PATENT DOCUMENTS

| | | | |
|---|---|---|---|
| 2,448,561 | 9/1948 | Way | 60/757 |
| 2,884,759 | 5/1959 | Sevcik | 60/757 |
| 3,064,424 | 1/1962 | Tomlinson | 60/757 |
| 3,307,354 | 3/1967 | Maccaulay et al. | 60/757 |
| 3,369,363 | 2/1968 | Campbell | 60/757 |
| 3,408,812 | 11/1968 | Stenger | 60/757 |
| 3,751,910 | 8/1973 | Sweeney et al. | 60/757 |

FOREIGN PATENT DOCUMENTS

| | | | |
|---|---|---|---|
| 700705 | 12/1953 | United Kingdom | 60/757 |

*Primary Examiner*—Carlton R. Croyle
*Assistant Examiner*—Jeffrey A. Simenauer
*Attorney, Agent, or Firm*—E. F. Possessky

[57] ABSTRACT

A combustor for a stationary combustor turbine is provided with a generally tubular sidewall formed from a telescopic arrangement of sidewall ring members. A corrugated spacer band supports the upstream end portion of each sidewall member on the downstream end portion of the next inwardly located sidewall member in the upstream direction. An annular coolant admission slot is thus provided between the sidewall members with the corrugated spacer band located therein.

The downstream end portion of each sidewall member extends as an annular lip projecting downstream from the downstream end of the corrugated band to discourage mixing of the hot internal gases with the coolant air flowing as a film through the slot and along the inner sidewall surface.

Thermal load is transmitted from the inner sidewall member through the corrugated band to the upstream end portion of the outer sidewall member where a slotted wall structure enables outer wall deflection which in turn permits radial growth of the inner sidewall member and its extended lip substantially without disturbing the slot coolant flow.

10 Claims, 6 Drawing Figures

TURBINE COMBUSTOR HAVING ENHANCED WALL COOLING FOR LONGER COMBUSTOR LIFE AT HIGH COMBUSTOR OUTLET GAS TEMPERATURES

This application is a continuation of application Ser. No. 06/248,123 filed Mar. 27, 1981.

CROSS REFERENCE TO RELATED APPLICATIONS

Ser. No. 679,292 entitled "Gas Turbine Combustion Chamber" filed by S. S. Osborn, S. R. Parker and E. W. Tobery, on Apr. 22, 1976, and now abandoned.

BACKGROUND OF THE INVENTION

The present invention relates to stationary combustion turbines and more particularly to combustors having a tubular stepped ring sidewall structure.

The stepped ring combustor design is commonly used to provide a capability for operating combustor baskets for extended periods of time at higher combustor gas temperatures needed to supply higher turbine inlet gas temperatures at higher engine efficiencies.

In the stepped ring design, the combustor sidewall is formed by rings which are disposed in telescopic relation to each other. The upstream end of each ring overlaps the downstream end of the next adjacent ring and is supported outwardly thereof, typically by an annular web-like support member or band.

An annular slot is thus provided between each pair of rings for admission of an annular film of relatively cool compressor discharge air from the enclosed turbine space about the combustor shell. As the air in the annular film flows downstream, heat is transferred to it from the combustor metallic sidewall and it generally holds the hot combustor gases away from contact with the combustor sidewall. As a result, combustor sidewall temperatures can be maintained below the metallurgical design temperature limit (such as 1500° F.) even though the combustor is producing turbine inlet gas at an elevated temperature such as 2200° F.

The performance of the stepped ring combustor design directly depends on the heat transfer coefficient and the cooling effectiveness of the annular film of air. The cooling effectiveness of the air film in turn depends on how well the film holds together against mixing with the hot internal combustor gases.

In general, it has been determined that an annular corrugated spacer band secured to the downstream end of each combustor sidewall ring and the upstream end of the next downstream sidewall ring is effective in providing the necessary rigidity for the combustor sidewall while providing relatively little obstruction to coolant air flow through the resultant annular space of slots between adjacent sidewall rings.

The spacer or support member used to secure the sidewall rings together provides an annular slot therebetween and obstructs the coolant air flow through the annular slot to a small extent. In the case of the annular corrugated spacer member, the total flow obstructing cross-section of the corrugation spacer walls is a relatively small percentage of the total cross-section of the annular slot.

As a consequence of the presence of the corrugated spacer walls, coolant air flow divides into stream flows within the respective corrugated spacer chambers within the annular slot. The stream flows rejoin as they emerge from the corrugated spacer with wakes existing between the stream flows for a limited distance downstream to the point where uniform annular flow may be resumed.

To discourage early mixing of the hot internal combustor gases with the coolant air film, an extended lip structure has been provided on the downstream end of each upstream sidewall ring. The lip forms an extension of the sidewall ring and thereby widens the annular slot in the downstream direction beyond the downstream end of the corrugated spacer. Extended lip structure of this kind is shown and described in U.S. Pat. No. 3,307,354 issued to R. W. McCauley, et al. on Mar. 7, 1967 and in a patent application U.S. Ser. No. 679,292 entitled Gas Turbine Combustion Chamber filed by S. S. Osborn, et al. on Apr. 22, 1976, assigned to the present assignee and now abandoned. Since the corrugated spacer band has relatively small obstruction cross section, the velocity of the annular coolant flow experiences little dropoff as it passes from the corrugated space member into the annular slot space defined by the extended lip.

With the extended lip structure, sufficient distance exists in the annular slot downstream of the corrugated spacer to permit dissipation of the wakes and substantial reformation of a uniform annular coolant flow prior to its exit from the slot into the combustion chamber.

As a result, the annualr film of coolant air tends to persist as it rapidly flows downstream along and against the inner surface of the combustion chamber sidewall while resisting mixing with the inner hot gas flow.

Some structural difficulties have been encountered with the extended lip structure. Thus, tests have demonstrated that the extended cantilevered lip is susceptible to buckling as it attempts to expand radially under thermal stress. When lip buckling has occurred, the annular coolant slot has become partially obstructed by the outward buckling lip portions causing major distortions in the coolant air flow through the slot followed by substantial hot gas mixing with the boundary air layer and a resultant significant or unacceptable loss of downstream cooling effectiveness on the chamber sidewall.

As shown in the aforementioned patent application, slots can be provided in the lip to allow for thermal growth without lip buckling. However, the gain made against buckling is offset to some extent by general weakening of the lip structure and by some resultant encouragement of mixing of the slot coolant air and the hot gas flow through the slots. The slotted lip thus can avoid buckling but it does so at some compromise in lip strength and cooling effectiveness.

SUMMARY OF THE INVENTION

The present invention provides a combustor structure which has both high structural integrity and high cooling effectiveness. The combustor sidewall comprises successive tubular sidewall members which overlap each other in a generally telescopic arrangement. An annular slot is provided between adjacent sidewall members with spacer means disposed in the slot and securing a radially inner downstream end portion of the upstream sidewall member to a radially outer upstream portion of the adjacent downstream sidewall member.

A tubular preferably solid lip is extended from the upstream sidewall member in the downstream direction from the downstream end of the annular spacer means to provide for wake dissipation in the slot coolant air flow. Radial thermal growth of the lip is transmitted radially outwardly through the spacer means to the upstream portion of the adjacent downstream sidewall member where means are provided for taking up the radial thermal growth substantially without disturbing the slot coolant air flow.

DESCRIPTION OF THE PREFERRED EMBODIMENT

Figure 1:
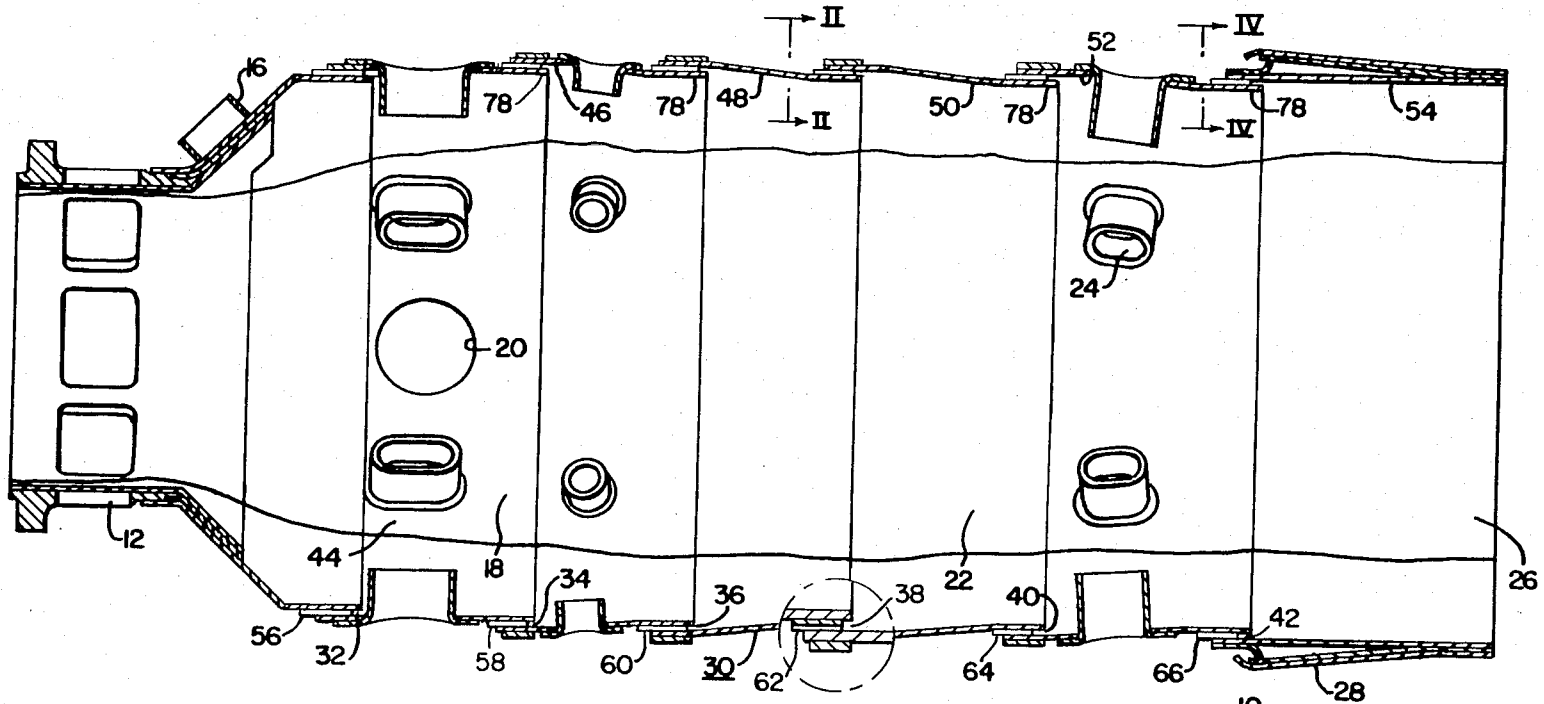
FIG. 1 shows an elevation view of a combustor basket constructed in accordance with the principles of the invention.

More particularly, there is shown in FIG. 1 a combustor basket 10 which is mounted in a stationary combustion turbine, along with other baskets like it, to generate hot motive gas for delivery through a transition duct (not shown) and stationary vanes (not shown) to drive the turbine blades (not shown). Fuel such as oil is supplied through a nozzle (not detailed) located within an upstream end portion or dome 12 of the basket 10. Ignition is provided by a conventional spring-biased ignitor (not shown) inserted through an ignition port 16.

Figure 4:
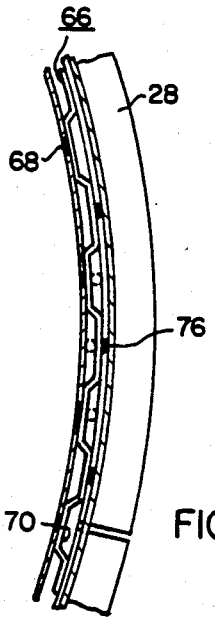
FIG. 4 shows an enlarged partial cross-section taken along line 4—4 of FIG. 1 to show a downstream end sidewall ring having spring means for coupling to a transition duct.
Figure 5:
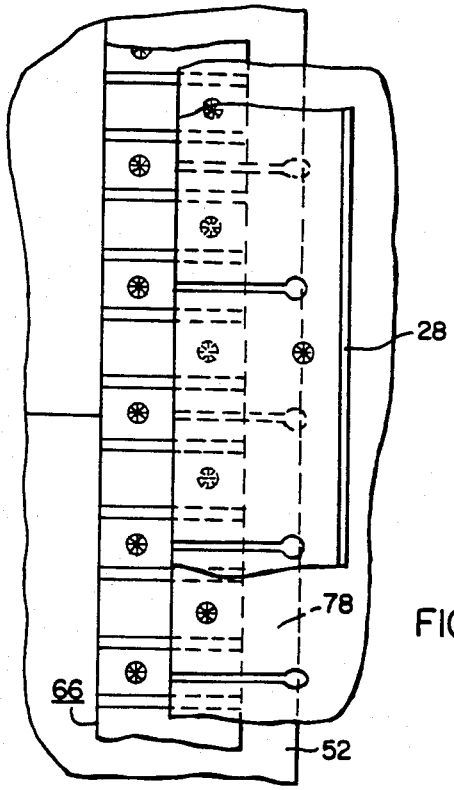
FIG. 5 shows a top plan view of portion of the combustor basket shown in FIG. 4.

Fuel combustion occurs in an internal primary combustion zone 18 with support from primary combustion air supplied through primary intake scoops 20. Dilution air flows into a secondary zone 22 in the combustor 10 through scoops 24 for mixing with the combustion products. The hot mixed motive gas flows through a downstream end portion 26 to the transition duct. An annular spring clip 28 (FIGS. 1, 4 and 5) spring supports the duct on the combustor 10 to provide for relative axial thermal growth between the duct and the combustor.

The combustor 10 is provided with a generally tubular sidewall 30 which contains the combustion and dilution zones 18 and 22. The hot gas flowing rapidly through the downstream combustor end 26 may be at a temperature of 2200° F. or higher. Since the highest temperature alloys, such as one traded under the name Hastalloy, have an upper operating temperature limit of 1500° F. to 1600° F., substantial heat must be removed from the combustor sidewall 30 to keep sidewall temperatures below the upper design temperature limit. The heat removal requirement is highest about the primary combustion zone where the hot flame produces direct radiation heating of the surrounding sidewall portions.

Some heat is removed from the sidewall 30 by the relatively cool air flowing over the combustor 10 in the encased turbine space outside the combustor 10. Since the external heat removal is inadequate to keep sidewall metal temperature below the limit value, additional cooling and/or thermal blanketing of the inner sidewall surface is needed.

The combustor sidewall 30 is accordingly structured to include a plurality of annular slots, in this case six slots 32, 34, 36, 38, 40 and 42, which are spaced along the hot gas flow path to admit respective annular films of coolant air which blanket the hot gases from the inner sidewall metal surface. The annular slots are respectively formed between adjacent sidewall members, i.e. the dome member 12 and sidewall rings 44, 46, 48, 50, 52 and 54.

The combustor sidewall 30 is generally rigidized by corrugated spacer bands 56, 58, 60, 62, 64 and 66 which are spot welded or otherwise secured to the adjacent sidewall members in the respective slots 32 through 42. The spacer band width is sufficient to provide the needed basket structural strength between adjacent sidewall members. The spacer band diameter is sufficient to permit spacer band placement on the downstream end of its sidewall member where its inner corrugations 70 are spot welded in place as indicated by the reference character 68 in FIGS. 2 and 3.

An upper end portion 72 (FIGS. 2 and 3) of the next downstream sidewall member is located over the corrugated spacer band and spot welded to radially outward corrugation 74 as indicated by the reference character 76.

Figure 2:
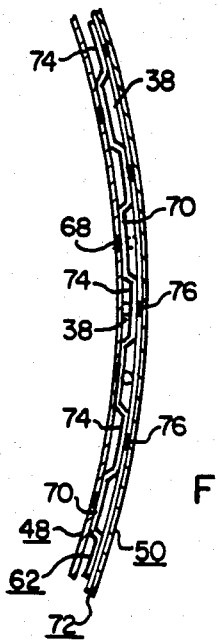
FIG. 2 shows an enlarged partial cross-section taken along line 2—2 of FIG. 1 to illustrate an annular coolant intake slot located between successive sidewall rings held together by a corrugated spacer band in the slot.

As observed in FIG. 2, the annular coolant slot 38, like the other coolant slots, is provided with limited obstruction by the spacer band cross-section. Preferably, each sidewall member is provided with an integral extension or lip 78 at its downstream end. In some applications, it may be desirable to provide the extended lip construction for only some of the annular coolant slots, such as those located about or near the primary combustion zone 18.

For reasons previously considered, each sidewall extended lip 78 provides for wake dissipation in the annular coolant flow which passes through the associated annular coolant admission slot.

It is generally desirable that the coolant film admitted through each annular slot be characterized with a high heat transfer coefficient for effective radiation heat removal from the sidewall metal and high coolant effectiveness both for enhanced heat removal from the sidewall and for thermal blanketing of the sidewall from the hot internal gas flow. Radiation heat received by the sidewall metal is removed by internal cooling in accordance with the formula:

$$\text{flame radiation} = h_i(T_W - T_F)$$

where;

$h_i$ = heat transfer coefficient $T_W$ = wall temperature $T_F$ = coolant film temperature High coolant air admission velocity is enhanced by slot dimensional design and by the fact that relatively little air velocity drop occurs across the annular coolant slot as a consequence of the relatively little aggregate spacer band cross-section and, consequently, the relatively slot cross-section enlargement from the upstream corrugated slot portion annulus to the slot portion over the lip 78. With high coolant air velocity, a high heat transfer coefficient is provided for heat removal by the coolant air film.

Coolant effectiveness is achieved by keeping the film temperature $T_F$ as low as possible, i.e. by retention of the coolant air flow as an annular film which resists mixing with the hot internal gas flow. Thus, coolant effectiveness is enhanced with increasing slot height in the radial direction and with decreasing the thickness of the extended lip 78. The coolant effectiveness is also increased with decreasing distance between the reference plane at which coolant and hot gas mixing may begin (i.e. at the end of the lip 78) and the downstream point at which maximum sidewall temperature occurs prior to the next downstream coolant admission slot.

The overall design requires a balancing process which results in a specified number of annular coolant slots with predetermined spacing along the combustor flow path and with predetermined annular slot cross-section. The extension distance of the lip 78 is sufficient to produce coolant wake dissipation but not so great that the lip is cantilevered to the point where it undergoes radial deformation with high temperature operation. As noted in the aforementioned patent application, a lip extension equal to eleven times the corrugation wall thickness provides good results. Thus, for a corrugation thickness of 50 mils, a lip extension of 0.4 inches has high performance effectiveness. Although tapering of the lip 78 can result in reduced mixing tendencies, it also reduces lip strength and is preferably employed (not in this embodiment) only where necessary.

With the old design, thermal growth of even a relatively short extension lip has resulted in lip buckling due to restriction by the corrugated spacer band against radial growth of the inner (hot) sidewall member at its downstream end. The present invention provides a commercially practical combustor structure in which the extended lip and other various elements operate to produce the coolant performance desired while providing the needed overall combustor basket strength with the flexibility needed to allow radial sidewall growth without lip distortion.

Figure 6:
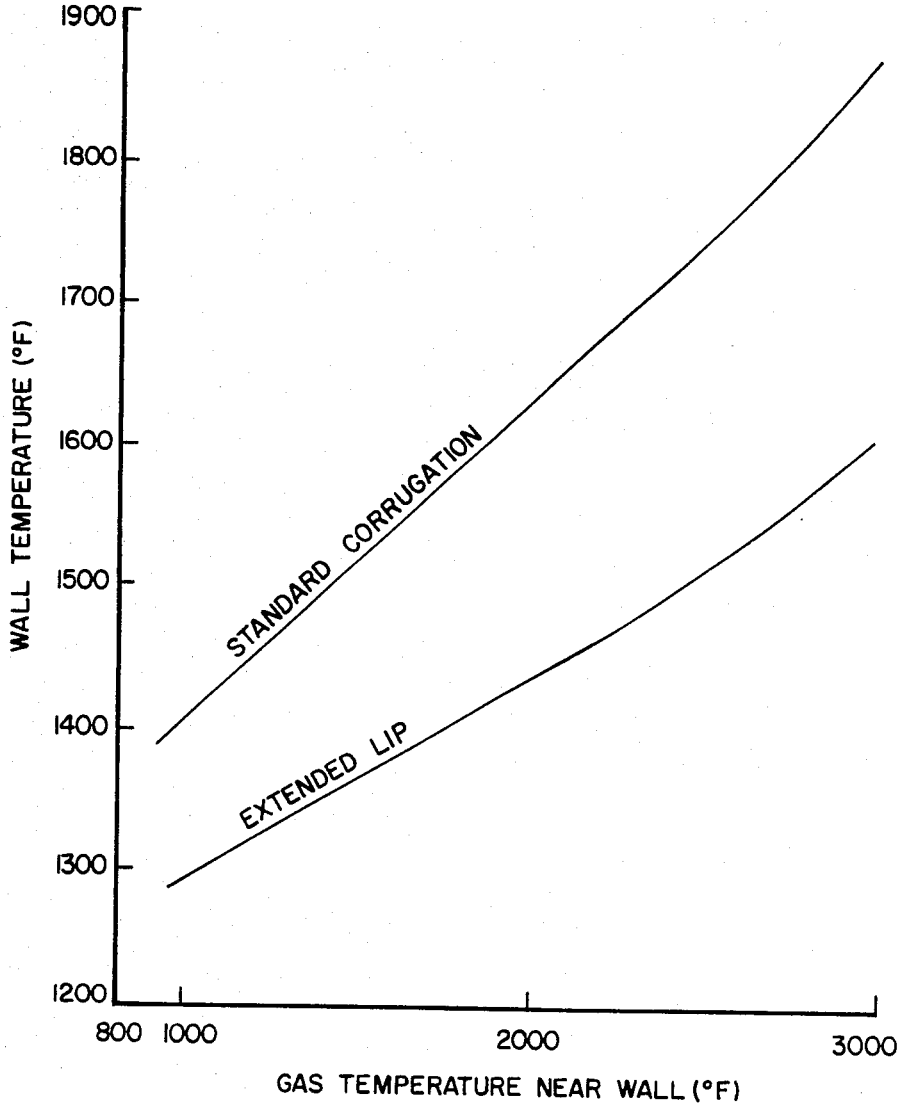
FIG. 6 shows a graph comparing cooling performance of the invention with performance of a typical prior art corrugated combustor.

A reliable combustor structure employing extended lips is highly desirable because the extended lip design allows reduced and therefore more efficient coolant flow while providing cooler combustor sidewalls with higher, more efficient combustor outlet gas temperatures. As shown in FIG. 6, extended lip construction provides significantly lower sidewall temperatures as compared to standard sidewall construction, and increasingly so as operating gas temperatures increase.

Figure 3:
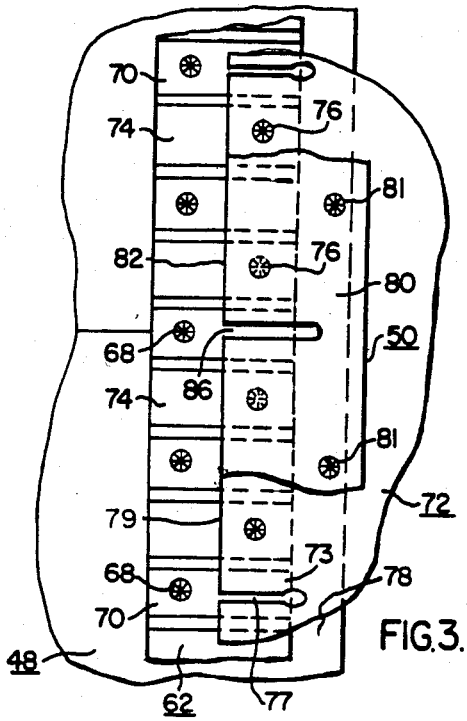
FIG. 3 shows a top plan view of the portion of the combustor basket shown in FIG. 2.

As shown in FIGS. 2 and 3, radial thermal load is transmitted from the inner (hot) sidewall member 48 through the corrugated spacer band 62 to the outer (cold) sidewall member 50 where it is received by the outer ring end portion 72.

To allow radial growth of the radially inward corrugated spacer band 62 and the downstream end portion including the lip 78 of the sidewall member 48, each ring upstream end portion 72 is provided with structure over the associated annular slot which deflects outwardly with increasing radially outward thermal loading. Such deflection occurs without substantial disturbance of coolant air flow through the annular slot 38.

The upstream end portion 72 includes a wall end section 73 which is provided with circumferentially spaced slots 77 which preferably have a keyholed shaped extending from upstream wall edge 79 in the downstream direction to a point downstream of the downstream end of the corrugated spacer band 62 and upstream of the free end of the lip 78. The welds 76 for securance of the corrugated spacer band 62 to the extended outer sidewall member are located between the slots 77 thereby transmitting radial load directly to the wide radially deflectable fingers formed on the end section 73 between the slots 77.

An outer cover band 80 is spot welded as indicated at 81 to the wall upstream end section 73 preferably with its upstream edge 82 aligned with the upstream edge 79 of the end section 73. Circumferentially spaced slots 86 are provided in the cover band 80. The slots 86 extend downstream a predetermined distance from the upstream cover edge 82 and are located circumferentially between the slots 77 in the underlying end wall section 73. In this manner, radially outward deflection of the cover band portion between the slots 86 and the wall end section portions between the slots 77 occurs with increasing radial outward load from the corrugated spacer band 62, yet external air is substantially blocked from entering the annular slot 38 and disturbing the coolant film through the slots 86 and 77. With provision for radial sidewall growth, the extended lip can likewise grow thermally in the radial direction substantially without disturbing the coolant air film. The benefits of extended lip construction are thus achieved in a high strength combustor having the flexibility needed for thermal sidewall growth.

What is claimed is:

1. A combustor for a stationary gas turbine having a generally tubular sidewall, said sidewall having a plurality of tubular sidewall members disposed in a generally telescopic arrangement, spacer means secured between an outwardly located upstream end portion of each of said sidewall members and an inwardly located downstream end portion of the adjacent upstream sidewall member to provide a generally annular coolant air admission slot between said end sidewall portions, said downstream end portion of at least one of said sidewall members having a generally tubular lip extending downstream from the downstream end of said spacer means to dissipate wakes in the associated slot coolant air flow, and said sidewall member upstream end portion of the next downstream sidewall member having deflection means which is structured to deflect radially outwardly and inwardly in such a manner that said spacer means and said one inner sidewall member including said extended lip are permitted to expand and contract in the radial direction under thermal load cycling substantially without lip buckling and without disturbing the coolant air film admitted through the associated annular coolant slot, said deflection means including an upper end section of said next downstream sidewall member having a plurality of circumferentially spaced slots extending in the downstream direction over the inwardly located coolant slot, and resilient means for covering said slotted end section substantially to prevent air admission through said slots when radial deflection occurs.

2. A combustor as set forth in claim 1 wherein said deflection enabling means includes a double walled upstream end portion of said next downstream sidewall member, said double walled end portion having a slotted inner wall and a slotted outer wall with the inner and outer wall slots extending in the downstream direction and being circumferentially displaced from each other.

3. A combustor as set forth in claim 1 wherein portions of said spacer means are secured to said slotted end section across areas between said sidewall member slots.

4. A combustor as set forth in claim 3 wherein said sidewall slots extend from the upstream edge of said next downstream sidewall member in the downstream direction beyond the downstream end of said spacer means.

5. A combustor as set forth in claim 3 wherein said spacer means is a corrugated band having outer corrugated portions spot welded to said slotted end section between said sidewall member slots and inner corrugated portions spot welded to said one sidewall member.

6. A combustor as set forth in claim 4 wherein each of said slots is a keyhole slot having an enlarged downstream located end portion.

7. A combustor as set forth in claim 1 wherein said resilient means comprises a cover band disposed over said next downstream sidewall member upstream end section to cover the inwardly located end section slots of said next downstream sidewall member, means for securing said cover band to said next downstream sidewall member, said cover band having a plurality of slots extending in the downstream direction and located circumferentially between the inwardly located slots of said sidewall member end section.

8. A combustor as set forth in claim 7 wherein said cover band slots extend from an upstream edge of said band to a downstream point beyond the downstream edge of said spacer means, said cover band having a downstream end strip portion welded to the inwardly located wall of said next downstream sidewall member.

9. A combustor as set forth in claim 7 wherein said spacer means is a corrugated band having outer corrugated portions spot welded to said slotted end section between said sidewall member slots and inner corrugated portions spot welded to said one sidewall member.

10. A combustor as set forth in claim 7 wherein portions of said spacer means are secured to said slotted end section across areas between said sidewall member slots, and wherein said sidewall slots extend from the upstream edge of said next downstream sidewall member in the downstream direction beyond the downstream end of said spacer means.

* * * * *